US008161705B2

(12) United States Patent
Pratt

(10) Patent No.: US 8,161,705 B2
(45) Date of Patent: Apr. 24, 2012

(54) WALL PANEL SYSTEM

(76) Inventor: James M. Pratt, Needham, MA (US)

( * ) Notice: Subject to any disclaimer, the term of this patent is extended or adjusted under 35 U.S.C. 154(b) by 221 days.

(21) Appl. No.: 12/583,561

(22) Filed: Aug. 24, 2009

(65) Prior Publication Data

US 2010/0236169 A1 Sep. 23, 2010

Related U.S. Application Data

(60) Provisional application No. 61/210,672, filed on Mar. 23, 2009.

(51) Int. Cl.
*E04C 2/00* (2006.01)
*E04B 2/00* (2006.01)
*E04B 2/98* (2006.01)

(52) U.S. Cl. ..... 52/506.05; 52/238.1; 52/288.1; 52/290; 52/476; 52/506.01

(58) Field of Classification Search ..... 52/169.12, 52/238.1, 242, 475.1, 476, 506.01, 506.05, 52/506.06, 509, 582.1, 716.8, 718.01, 718.07, 52/287.1, 288.1, 290; 403/326; 248/228.6, 248/231.71, 231.81
See application file for complete search history.

(56) References Cited

U.S. PATENT DOCUMENTS

| | | | | |
|---|---|---|---|---|
| RE13,910 | E * | 5/1915 | Friedel | 52/718.01 |
| 2,073,278 | A * | 3/1937 | Hohl | 52/461 |
| 3,312,021 | A * | 4/1967 | Rolland | 52/126.3 |
| 5,014,934 | A * | 5/1991 | McClaflin | 244/132 |
| 5,537,791 | A * | 7/1996 | Champagne | 52/520 |
| 5,901,514 | A * | 5/1999 | Wolfe | 52/242 |
| 6,619,001 | B1 * | 9/2003 | Pratt | 52/169.5 |
| 7,313,891 | B2 * | 1/2008 | Showers | 52/267 |
| 2009/0077922 | A1 * | 3/2009 | Pettine et al. | 52/698 |

* cited by examiner

*Primary Examiner* — Brian Glessner
*Assistant Examiner* — Joseph J Sadlon
(74) *Attorney, Agent, or Firm* — Willliam Nitkin

(57) ABSTRACT

A wall panel retention system including an upper panel retention structure incorporating the ceiling molding and a lower panel retention structure incorporating the base molding with retention structures for holding the sides of the wall panels to the building wall.

7 Claims, 2 Drawing Sheets

FIG. 2
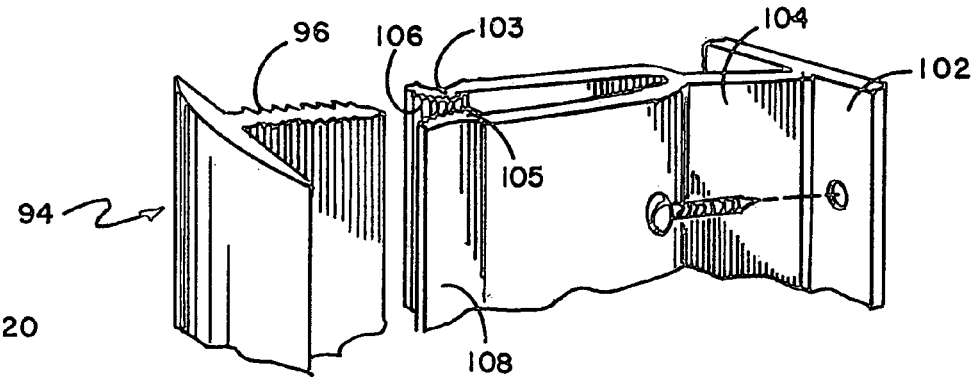
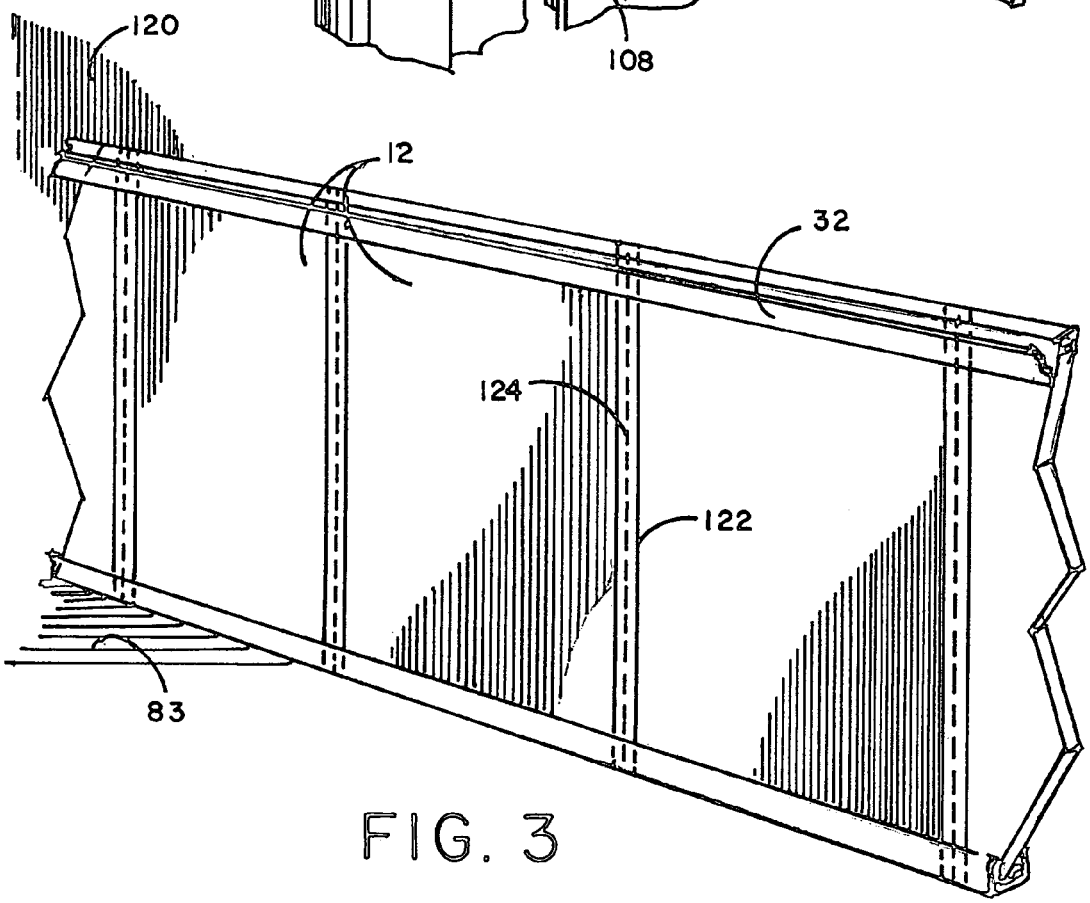
FIG. 3

WALL PANEL SYSTEM

This application claims priority and benefit of a provisional patent application entitled Wall Panel System, Application No. 61/210,672 filed Mar. 23, 2009, now pending.

FIELD OF THE INVENTION

The present invention resides in the field of systems for installing finishing wall panels in a basement and more particularly relates to structures for retention of such wall panels adjacent to one another to provide for improved comfort and to give an attractive appearance to a basement area.

HISTORY OF THE PRIOR ART

The use of insulating panels to cover basement foundation walls is well known in the prior art. An example of such a system can be found in U.S. Pat. No. 4,525,960 to Kelman where a plurality of glass fiber boards are disposed adjacent to the basement walls and are held in place by systems that provide upper and lower retention means as well as retention means extending vertically between adjacent strips to hold such strips in place to form an overlying and improved wall surface that provides insulation and an aesthetically pleasing surface. Examples of such vertical retention structures can be found in U.S. Pat. No. 1,772,417 to Ellinwood and U.S. Pat. No. 2,998,112 to Burgin. These panel insulation systems utilize upper and lower retention frame structures and vertical snap-in retention members between adjacent panels. Another example of such prior art systems is found in Patent Application Publication 2007/0199270 to Weir et. al. owned by Owens Corning which teaches a system having retention frame structures being upper and lower trim pieces which are attached to the basement walls and retain the upper and lower portions of a panel while vertical trim pieces cover the seams between adjacent panels and securely hold the adjacent panels' side edges.

SUMMARY OF THE INVENTION

It is an object of the present invention to provide an improved wall panel system for finishing basements incorporating a novel upper and lower panel retention system to retain a plurality of wall panels in side-by-side relationship adjacent to a basement wall. The upper and lower panel retention members and their insertable crown and baseboard moldings provide an improved aesthetic appearance to a basement while allowing for good air circulation above, under and behind the wall panels while at the same time allowing for easy installation of wiring and other utilities to desired locations within the basement through channels formed in the upper and lower panel retention members. Further, the system of this invention allows for a selection of crown and baseboard moldings that can be varied in ornamental shape to satisfy the various design tastes of the user. In applicant's system the upper panel retention member retains the upper portion of each panel, and the lower panel retention member is installed against the basement wall to receive the bottom portion of the panel. Both the upper panel retention member and lower panel retention member have horizontally protruding catch members. The upper panel retention member's catch member receives the crown molding thereon, and the lower retention member receives the baseboard molding thereon in a fashion, as described below. Both the upper panel retention member and the lower panel retention member have ledges formed therein, creating areas for air circulation and for extending wires, cables and other utilities therethrough such as to provide electricity, cable television and the like to desired areas of the basement.

Between adjacent panels is a vertically disposed retention member having a base that is attached to the basement wall and a receipt slot with engagement means defined therein. When the adjacent panels are in place on both sides of the vertically disposed retention member, the insert portion can be pushed into the engagement portion extending from the retention member to urge against, and securely retain, the adjacent panels' edges positioned behind the insert portion.

The generally 4×8 foot or 2×8 foot panels utilized in the wall panel system of this invention can be made having a core of fire-rated insulation that is approximately 2 inches thick with a ⅛ inch plastic, fire-rated panel disposed in the front thereof. The core can be made of a water-resistant, thermally and acoustically insulating material that is germicide-treated on the front and back of the panel. The ceiling goes over the top of the wall so that panels can be easily removed. In the prior art the ceiling frequently engages into the new wall, making it difficult to remove such wall unlike the wall of the present invention which is built below the ceiling.

BRIEF DESCRIPTION OF THE DRAWINGS

FIG. 2 illustrates a perspective view of a small section of a vertically disposed retention member between adjacent wall panels.

FIG. 3 illustrates a perspective view of a number of wall panels positioned upright against a wall surface utilizing the wall panel system of this invention.

DESCRIPTION OF THE PREFERRED EMBODIMENT(S)

Figure 1:
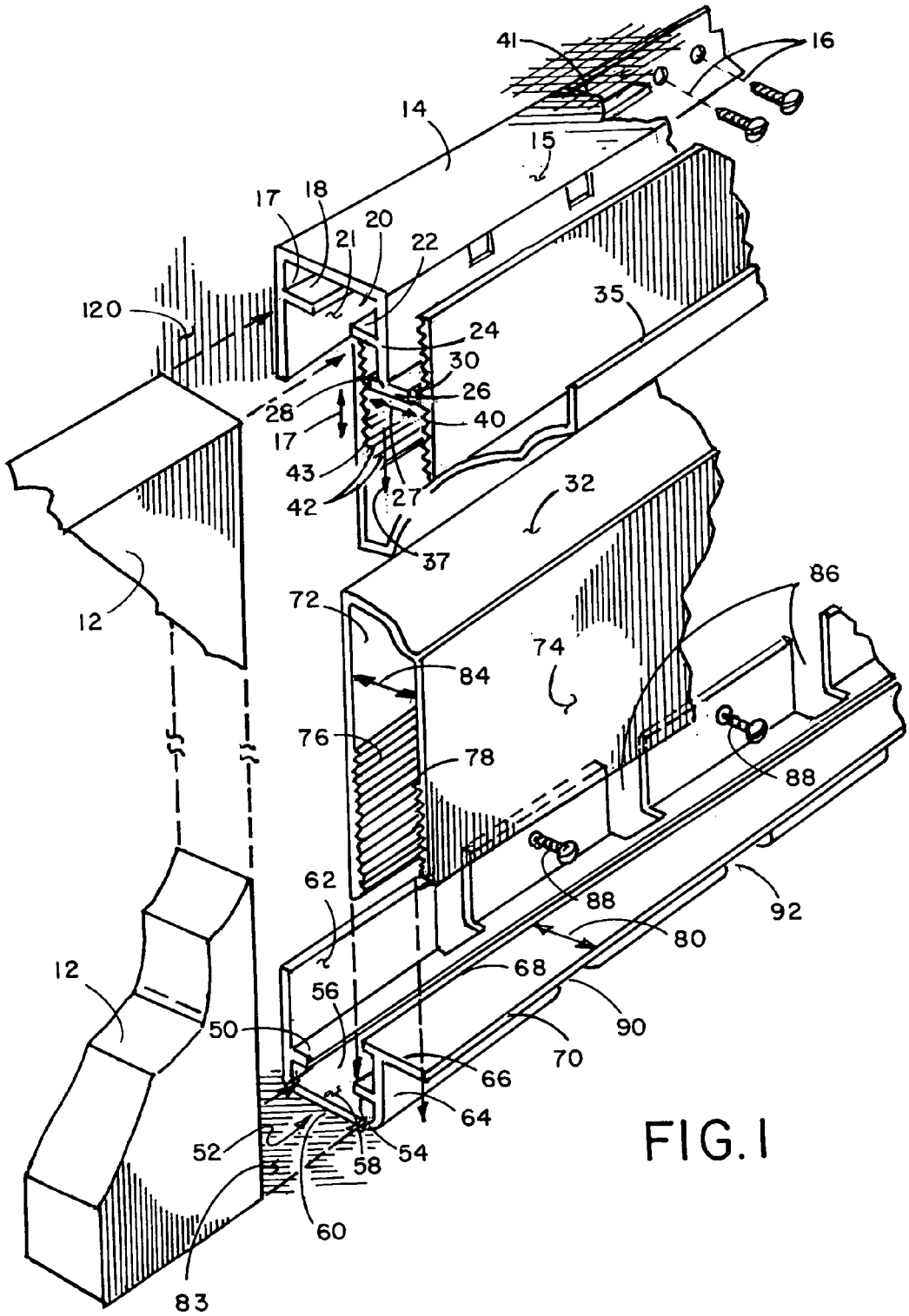
FIG. 1 illustrates a perspective cutaway view of the upper and lower panel retention members and the crown and baseboard moldings of the wall panel system of this invention.

The wall panel system of this invention is utilized to place paneling adjacent to one another against a building wall 120 such as found in a basement. Although the wall panel system of this invention is described herein as being installed in a basement, such system can be installed in other locations as well. The wall panels described below can be of a foam composition covered by a thin, plastic, fire-rated facing sheet. The panels can be retained to the wall by a system holding them at their tops and bottoms and along their adjoining side edges 122 and 124, as seen in FIG. 3, so that they are retained yet easily removable for gaining access to the wall behind, if needed. It should be noted that the ceilings are built over the tops of the structure of the new wall and are not attached in any way to the new wall and crown molding so that the panels are easily removable. As seen in FIG. 1 the tops of the panels are held by an ceiling retention member 14 which is a generally elongated, inverted U-shaped member having an ceiling retention member wall mount 16 which U-shaped member can be screwed to the basement wall or to the ceiling. Ceiling retention member 14 also includes an inner spacing ledge 18 and an outer spacing ledge 22 which are disposed protruding toward one another somewhat down from top 15 of ceiling retention member 14, defining a retention member slot 20 therebetween that allows for air circulation and, if needed, utility wire passage in air space 21 defined in ceiling retention member 14 disposed above the top of the wall panels when in place. In using ceiling retention member 14, wall panel 12 is inserted up to and stops at inner spacing ledge 18 and outer spacing ledge 22, leaving air space 21 thereabove above retention member slot 20. The front of ceiling retention member 14 is a downwardly extending ceiling retention member molding mount support 24 which has at its bottom crown molding catch member 26 which is positioned perpendicular to ceiling retention member molding mount support 24 and, when installed, is disposed parallel to the ceiling and floor. It should be noted that the ceiling is installed over the new wall and is not attached to it. Crown molding catch member 26 has an inner catch member 28 that extends inward therefrom toward the wall when installed and outer catch member 30 which extends outward therefrom away from building wall 120 when installed. Elongated crown molding 32, which can be molded in one piece, is attached to crown molding catch member 26 and extends outward and upwards in the form of an angular member in front of the tops of the wall panels after the wall panels have been inserted into the space below inner and outer spacing ledges 18 and 22 of ceiling retention member 14. Crown molding 32 has a rear catch member engagement member 38 thereon which passes between wall panel 12 when in place in the ceiling retention member 14 when installed and which rear catch member engagement member 38 has teeth 42 thereon which engage against and catch when passed by inner catch member 28 of crown molding catch member 26. Crown molding 32 also has front catch member engagement member 40 which has on its inner side the same type of teeth 39 as rear catch member engagement member 38 that engage and catch against outer catch member 30 so as to have the front catch member engagement member 40 also catch and be retained thereagainst so that crown molding 32 can be engaged onto crown molding catch member 26 and pushed upward to the height of ceiling 41 and be retained in its position. Crown molding 32, being made of flexible plastic, can be easily disengaged and manually removed at any later date desired to service or replace the wall panels therebehind. The wall panel system of this invention also allows the rear of rear catch member engagement member 38 to engage against a top portion of wall panel 12 to help retain that portion of the wall panel in place. It should be noted that rear catch member engagement member 38 and front catch member engagement member 40 are spaced apart a distance 27 from one another and extend vertically when installed which corresponds to the width of crown molding catch member 26 such that teeth 37 and 39 on the sides, respectively, of rear catch member engagement member 38 and front catch member engagement member 40 extend inward and contact, respectively, inner catch member 28 and outer catch member 30 of crown molding catch member 26 to retain crown molding 32 thereto. Height 17 of rear catch member engagement member 38 can extend to and contact outer spacing ledge 22 when crown molding 32 has its rear catch member engagement member 38 and front catch member engagement member 40 engaged to inner and outer catch members 28 and 30 of crown molding catch member 26, and crown molding 32 is moved upwards, engaging it onto crown molding catch member 26 until the top 35 of crown molding 32 contacts ceiling 41 while at the same time rear face 43 of rear catch member engagement member 38 contacts and retains the upper portion of wall panel 12. In this way crown molding 32 not only acts to effectively retain the upper portion of wall panel 12 in place, but also by pushing crown molding 32 upwards as needed, ceiling 41 can be contacted at all points because of the flexibility of elongated crown molding 32 to bend and accommodate ceilings that may not be perfectly straight.

Only the top portion and bottom portion of wall panel 12 are shown in FIG. 1. Although the top and bottom portions appear close to one another, in actuality there can be any distance, such as 8 feet or the like, between them depending on the height of the ceiling and the paneling used.

A similar retention system is utilized to retain the bottom of wall panel 12 wherein a baseboard retention member 52 is attached to floor 83 or to building wall 120 therebehind by screws or nails. Baseboard retention member 52 has attached at the front of its bottom 60 a base catch member support 64 and at the rear of its bottom is attached rear retention member portion 62 which extends at right angles vertically from bottom 60. Attachment means, such as screws, can be driven through bottom 60 into floor 83 or through rear retention member portion 62 into building wall 120 to retain baseboard retention member 52 in place against building wall 120 on floor 83. Extending from rear retention member portion 62 of baseboard retention member 52 at a right angle thereto and parallel to bottom 60 of baseboard retention member 52 is first lower spacer 50. Also extending from base catch member support 64 is second lower spacer 54 which extends toward, and is parallel to, first lower spacer 50 and defines therebetween base member slot 56 which is above base member utility receipt area 58 that is defined by first and second lower spacers 50 and 54. Wall panel 12 can fit within baseboard retention member 52 and rests upon first and second lower spacers 50 and 54 leaving the space below, being base member utility receipt area 58 available for the passage of electric lines and other utilities therethrough. Also base member utility receipt area 58 allows for air to move easily pass under and behind wall panel 12. Base catch member support 64 extends upwards to base catch member 66 which is disposed perpendicularly on the top thereof and has a width 80 with the inner portion of base catch member 66 defining an inner baseboard catch 68 and its outer portion defining an outer baseboard catch 70. Baseboard member 82 is an inverted U-shaped structure made of a flexible plastic having an inner leg forming an inner baseboard engagement member 72; and an outer leg forming outer baseboard engagement member 74 which are spaced apart a distance 84 defined between inner baseboard engagement member teeth 76 and outer baseboard engagement member teeth 78 such that distance 84 therebetween is sufficient to engage the sides of base catch member 66 when baseboard member 82 is maneuvered downward thereover such that inner baseboard engagement member teeth 76 catch onto and retain inner baseboard catch 68, and outer baseboard engagement member teeth 78 at the same time engages and retains onto outer base catch member 70, allowing baseboard member 82 to be pushed downward over base catch member 66 until the bottom of outer baseboard engagement member 74 contacts floor 83. At the same time that baseboard member 82 is positioned in place, the rear of inner baseboard engagement member 72 contacts and holds wall panel 12 securely in place against rear retention member portion 62 of retention member 52 and building wall 120. Baseboard member 82 is made of flexible and resilient plastic material and can be lifted upwards and disengaged from base catch member 66 at any time one wishes to remove wall panel 12. A plurality of screw retention apertures 86 can be provided for receipt of corresponding screws 88 which can attach baseboard retention member 52 to floor 83 or to building wall 120. Also there can be provided a plurality of slots in baseboard retention member 52, such as first and second passage slots 90 and 92 which can extend into the area from the front of baseboard retention member 52 to the rear thereof for better air circulation and to ease the installation of utility wires therein.

While the crown molding and baseboard retention structures hold, respectively, the top portions and bottom portions of wall panels 12 against building wall 120, side edges 122 and 124 of adjoining wall panels must be retained in position as well, as illustrated in FIG. 3. To accomplish this goal, a retention member 94, as shown in FIG. 2, is provided. Retention member 94 is wide enough to cover side edges 122 and 124 of two adjacent wall panels 12, as seen in FIG. 3, to retain them in position. Retention member 94 extends almost the full height of the wall panel and has a retention member insert 96 which is toothed for insertion and retention in retention receipt member 98 which has sawtooth projections 103 and 105, respectively, on first and second retention receipt member sides 106 and 108 of retention receipt member 98. Retention receipt member 98 has opening 100. Retention receipt member 98 is positioned and attached to building wall 120 by retention receipt member base 102 which is screwed to building wall 120. Retention receipt member 98 is positioned away from retention receipt member base 102 by retention member pedestal 104 to allow wall panels 12 to come together easily on each side thereof as wall panels 12 have some resilience for receiving retention receipt member 98 therebetween. As discussed above, the width of retention member 94 is sufficient to cover the edges of both adjacent wall panels when they are spaced somewhat apart from one another. Retention receipt member 98 has first and second retention receipt member sides 106 and 108 which have sawtooth projections 103 and 105 thereon for engagement with the sides of retention member insert 96 when positioned therein to securely retain retention member 94 against the side edges of two adjoining wall panels 12 to retain them in position along their junction. When one wishes to remove a wall panel, one manually pulls retention member insert 96 out of opening 100 wherein sawtooth projections 103 and 105, respectively, of first and second retention receipt member sides 106 and 108 are resilient enough to spread apart to allow retention member insert 96 to be pulled therefrom and to allow the wall panels to be removed once crown molding 32 and baseboard member 82 have been removed.

Although the present invention has been described with reference to particular embodiments, it will be apparent to those skilled in the art that variations and modifications can be substituted therefor without departing from the principles and spirit of the invention.

I claim:

1. A system for installing at least two generally rectangular wall panels disposed adjacent to one another against a building wall having an upper portion and a lower portion, a ceiling and a floor, each of said wall panels having a top, a bottom and first and second sides, comprising:

an upper panel retention structure having an elongated inverted U-shaped member, said inverted U-shaped member having a top, a downwardly disposed inner side and an downwardly disposed outer side, said downwardly disposed outer side having a bottom;

mounting means for attaching said inverted U-shaped member to said upper portion of said building's wall or to said ceiling;

a ceiling molding mount attached perpendicular to said bottom of said downwardly disposed outer side of said inverted U-shaped member, said ceiling molding mount being disposed parallel to said ceiling, said ceiling molding mount having a width, an inner side and an outer side; said inner side forming an inner catch member and said outer side forming an outer catch member;

an elongated ceiling molding formed in a generally U-shape, said ceiling molding having:

a rear catch member and a front catch member disposed apart from one another a distance that is approximate to said width of said ceiling molding mount;

a crown molding front in a selected shape of said ceiling molding from which said rear catch member and said front catch member vertically extend, said ceiling molding attachable to said ceiling molding mount by disposing said rear catch member adjacent to, and contacting, said inner side of said ceiling molding mount and disposing said front catch member adjacent to, and contacting, said outer side of said ceiling molding mount for engaging said ceiling molding to said ceiling molding mount by maneuvering said ceiling molding upwards toward said ceiling while said ceiling molding is engaged onto said ceiling molding mount and at the same time said ceiling molding is retaining said top of said wall panel to said building wall;

a lower panel retention structure having an elongated U-shaped member herein referred to as the lower U-shaped member, said lower U-shaped member having a bottom, an upwardly disposed inner side and an upwardly disposed outer side, said upwardly disposed outer side having a top;

mounting means for attaching said lower U-shaped member to the bottom of said building's wall or said floor;

a base molding mount attached perpendicular to the top of said upwardly disposed outer side of said lower U-shaped member, said base molding mount being disposed parallel to said floor, said base molding mount having a width, an inner side, and an outer side; said inner side forming an inner base molding catch member and said outer side forming an outer base molding catch member;

an elongated base molding formed in a generally inverted U-shape, said base molding having:

a rear base catch member and a front base catch member disposed apart from one another a distance that is approximate to said width of said base molding mount; and said base molding front catch member forming a base molding front in a selected shape of said base molding, said base molding attachable to said base molding mount by disposing said rear base catch member to said inner side of said base molding mount and disposing said front base catch member adjacent to said outer side of said base molding mount for engaging said base molding to said base molding mount by maneuvering said base molding downwards toward said floor while said base molding is engaged onto said base molding mount and at the same time said base molding is retaining said bottom of said wall panel to said building wall.

2. The system of claim 1 further including retention means for retaining said first and second sides of each of said wall panels to said building wall.

3. A system for installing at least two generally rectangular wall panels disposed adjacent to one another against a building wall having an upper portion and a lower portion, a ceiling and a floor, each of said wall panels having a top, a bottom and first and second sides, comprising:

an upper panel retention structure having an elongated inverted U-shaped member, said inverted U-shaped member having a top, a downwardly disposed inner side and an downwardly disposed outer side, said downwardly disposed outer side having a bottom;

mounting means for attaching said inverted U-shaped member to said upper portion of said building's wall or to said ceiling;

first and second upper ledges disposed inwardly parallel to one another, and extending, respectively, from said downwardly disposed inner side and said downwardly disposed outer side of said inverted U-shaped member; said first and second upper ledges having a retention slot defined therebetween, said first and second ledges disposed at a level spaced downward from said top of said inverted U-shaped member;

a ceiling molding mount attached perpendicular to said bottom of said downwardly disposed outer side of said inverted U-shaped member, said ceiling molding mount being disposed parallel to said ceiling, said ceiling molding mount having a width, an inner side, and an outer side; said inner side forming an inner catch member and said outer side forming an outer catch member;

an elongated ceiling molding formed in a generally U-shape, said ceiling molding having:

a rear catch member and a front catch member disposed apart from one another a distance that is approximate to said width of said ceiling molding mount;

a crown molding front in a selected shape of said ceiling molding from which said rear catch member and said front catch member vertically extend, said ceiling molding attachable to said ceiling molding mount by disposing said rear catch member adjacent to, and contacting, said inner side of said ceiling molding mount and disposing said front catch member adjacent to, and contacting, said outer side of said ceiling molding mount for engaging said ceiling molding to said ceiling molding mount by maneuvering said ceiling molding upwards toward said ceiling while said ceiling molding is engaged onto said ceiling molding mount and at the same time said ceiling molding is retaining said top of said wall panel to said building wall;

a lower panel retention structure having an elongated U-shaped member herein referred to as the lower U-shaped member, said lower U-shaped member having a bottom, an upwardly disposed inner side and an upwardly disposed outer side, said upwardly disposed outer side having a top;

mounting means for attaching said lower U-shaped member to the bottom of said building's wall or said floor;

a base molding mount attached perpendicular to the top of said upwardly disposed outer side of said lower U-shaped member, said base molding mount being disposed parallel to said floor, said base molding mount having a width, an inner side, and an outer side; said inner side forming an inner base molding catch member and said outer side forming an outer base molding catch member;

an elongated base molding formed in a generally inverted U-shape, said base molding having:

a rear base catch member and a front base catch member disposed apart from one another a distance that is approximate to said width of said base molding mount; and said base molding front catch member forming a base molding front in a selected shape of said base molding, said base molding attachable to said base molding mount by disposing said rear base catch member to said inner side of said base molding mount and disposing said front base catch member adjacent to said outer side of said base molding mount for engaging said base molding to said base molding mount by maneuvering said base molding downwards toward said floor while said base molding is engaged onto said base molding mount and at the same time said base molding is retaining said bottom of said wall panel to said building wall.

4. The system of claim 3 further including retention means for retaining said first and second sides of each of said wall panels to said building wall.

5. A system for installing at least two generally rectangular wall panels disposed adjacent to one another in a basement having a building wall having an upper portion and a lower portion, a ceiling and a floor, each of said wall panels having a top, a bottom, first and second sides, each of said sides having a side edge, comprising:

an upper panel retention structure having an elongated inverted U-shaped member, said inverted U-shaped member having a top, a downwardly disposed inner side and an downwardly disposed outer side, said downwardly disposed outer side having a bottom;

a plurality of air vent apertures defined in said inner side and said outer side of said inverted U-shaped member;

mounting means for attaching said inverted U-shaped member to said upper portion of said building's wall or to said ceiling;

first and second upper ledges disposed inwardly parallel to one another, and extending, respectively, from said downwardly disposed inner side and said downwardly disposed outer side of said inverted U-shaped member; said first and second upper ledges having a retention slot defined therebetween, said first and second ledges disposed at a level spaced downward from said top of said inverted U-shaped member forming a channel between said first and second upper ledges for receipt of utilities therein and for air circulation therethrough and through said vent apertures;

a ceiling molding mount attached perpendicular to said bottom of said downwardly disposed outer side of said inverted U-shaped member, said ceiling molding mount being disposed parallel to said ceiling, said ceiling molding mount having a width, an inner side, and an outer side; said inner side forming an inner catch member and said outer side forming an outer catch member;

an elongated ceiling molding formed in a generally U-shape, said ceiling molding having:

a rear catch member and a front catch member disposed apart from one another a distance that is approximate to said width of said ceiling molding mount;

a crown molding front in a selected shape of said ceiling molding from which said rear catch member and said front catch member vertically extend, said ceiling molding attachable to said ceiling molding mount by disposing said rear catch member adjacent to, and contacting, said inner side of said ceiling molding mount and disposing said front catch member adjacent to, and contacting, said outer side of said ceiling molding mount for engaging said ceiling molding to said ceiling molding mount by maneuvering said ceiling molding upwards toward said ceiling while said ceiling molding is engaged onto said ceiling molding mount and at the same time said ceiling molding is retaining said top of said wall panel to said building wall;

a lower panel retention structure having an elongated U-shaped member herein referred to as the lower U-shaped member, said lower U-shaped member having a bottom, an upwardly disposed inner side and an upwardly disposed outer side, said upwardly disposed outer side having a top;

a plurality of air vent apertures defined in said inner side and said outer side of said lower U-shaped member;

mounting means for attaching said lower U-shaped member to the bottom of said building's wall or said floor;

first and second lower ledges disposed inwardly parallel to one another, and extending, respectively, from said upwardly disposed inner side and said upwardly disposed outer side of said lower U-shaped member; said first and second lower ledges having a lower retention slot defined therebetween, said first and second lower ledges disposed at a level spaced upward from said bottom of said lower U-shaped member forming a channel between said first and second lower ledges for receipt of utilities therein and for air circulation therethrough and through said vent apertures;

a base molding mount attached perpendicular to the top of said upwardly disposed outer side of said lower U-shaped member, said base molding mount being disposed parallel to said floor, said base molding mount having a width, an inner side, and an outer side; said inner side forming an inner base molding catch member and said outer side forming an outer base molding catch member;

an elongated base molding formed in a generally inverted U-shaped, said base molding having:

a rear base catch member and a front base catch member disposed apart from one another a distance that is approximate to said width of said molding mount; and said base molding front catch member forming a base molding front in a selected shape of said base molding, said base molding attachable to said base molding mount by disposing said rear base catch member to said inner side of said base molding mount and disposing said front base catch member adjacent molding mount by maneuvering said base molding downwards toward said floor while said base molding is engaged onto said base molding mount and at the same time said base molding is retaining said bottom of said wall panel to said building wall.

6. The system of claim 5 further including retention means for retaining said first and second sides of each of said wall panels to said building wall.

7. The system of claim 6 wherein said retention means include a receipt member attached to said building wall, said receipt member having a toothed opening defined between two adjacent wall panels and a retention member having sides for extending somewhat over said side edges of said two adjacent wall panels and engaging into said toothed opening.

* * * * *